US006584041B1

(12) United States Patent
Terzian et al.

(10) Patent No.: US 6,584,041 B1
(45) Date of Patent: Jun. 24, 2003

(54) UNIDIRECTIONAL SEGMENTED DIGITAL TIME DISPLAYS

(75) Inventors: Berj A. Terzian, Newbury, MA (US); Robert Alfred Brodmann, Weehawken, NJ (US)

(73) Assignee: Equitime, Inc., Newbury, MA (US)

( * ) Notice: Subject to any disclaimer, the term of this patent is extended or adjusted under 35 U.S.C. 154(b) by 0 days.

(21) Appl. No.: 10/340,304

(22) Filed: Jan. 10, 2003

(51) Int. Cl.[7] ..... G04C 19/00; G04C 17/00
(52) U.S. Cl. ..... 368/82; 368/239
(58) Field of Search ..... 368/82–84, 239–242, 368/223

(56) References Cited

U.S. PATENT DOCUMENTS 4,271,497 A 6/1981 Terzian
4,627,737 A 12/1986 Nance et al.
6,215,736 B1 4/2001 Terzian
6,418,085 B2 7/2002 Terzian
2002/0089897 A1 7/2002 Terzian

*Primary Examiner*—Vit Miska
(74) *Attorney, Agent, or Firm*—Muserlian, Lucas and Mercanti

(57) ABSTRACT

Unidirectional segmented digital timekeeping systems are provided by multiple display elements which are activated to display current hour digit(s) and four selected groups of respective elapsed minute digits which traverse around the hour digit in successive segments of relatively upper and lower quarter hour positions on the right side and during the first half of the current hour, followed by relatively lower and upper quarter hour positions on the left side and during the second half of the current hour. Such displays may be modified to combine with quadribalanced or enhanced quadribalanced digital time displays to provide bidirectional elapsed and remaining timekeeping systems.

19 Claims, 4 Drawing Sheets

UNIDIRECTIONAL SEGMENTED DIGITAL TIME DISPLAYS

BACKGROUND OF THE INVENTION

1. Field of the Invention

This invention relates to timekeeping and, more particularly, to the use of digital time displays for general purpose timekeeping, as most individuals normally employ in conducting their daily activities within desired time schedules or requirements.

2. Description of the Prior Art

Balanced, quadribalanced and enhanced quadribalanced digital time displays are disclosed in the prior art. Examples of patents which describe such displays include U.S. Pat. No. 4,627,737, U.S. Pat. No. 4,271,497 and U.S. Pat. No. 6,215,736 B1, the disclosures of which are incorporated herein by reference. These displays have a common characteristic, which is that at the conclusion of the first half of each hour, the time information transitions from elapsed time to remaining time.

More specifically, during the first half hour, the current hour in these displays is flanked on its right side by incrementing elapsed minutes in a single or dual up/down position. Thereafter the hour value increases by one to display the forthcoming next hour, minutes switch to a single or dual down/up position flanking the left side of the next hour and begin counting down the remaining minutes before the commencement of the next hour. An optional display of seconds counting up from zero to 59 during each elapsed minute and counting down from 59 to zero during each remaining minute also can be included.

3. Recognition of Problems in the Prior Art

Some individuals have expressed reservations about a transition, for example, from 12:30 and 30 seconds to 29 seconds and 29 minutes until 1:00, as occurs in the prior art displays. These feelings seem to be caused by the fact that as much time then remains to the next hour as has passed after the current hour, i.e., both periods are about equal. Therefore, there is a tendency by some to think that it is too soon to change from looking at past time to seeing and using a future time display. This seems to be confirmed by other opinions that the prior art remaining time displays are more fitting or useful as the hour comes closer to the beginning of the next hour. Apparently, as the remaining minutes lessen, it is thought better then to see how many are left before the next hour begins.

Another concern mentioned by some is whether viewers will be confused by the unusual placement of remaining minute digits on the left side of the hour, since conventional digital time displays traditionally have always placed all hour values in the lead position to be read first, followed by elapsed minutes in the trailing position on the right.

To a large extent, these problems or concerns are probably the product of unfamiliarity with the prior art balanced time displays, which to date have not been widely available in commerce. On the other hand, the time required to teach neophytes how to read such displays being less than a minute, from then on growing familiarity with the easily understood operating principles of the balanced time modes should be effective to substantially dispel the above problems or concerns.

SUMMARY OF THE INVENTION

The present invention provides a simple and effective solution to the foregoing difficulties which allows viewers to read unidirectionally displayed elapsed time throughout each hour in a new way. Specifically, in a digital time display, current hours are centrally digitally displayed while elapsed minutes are graphically digitally displayed to traverse around the current hour digital display in four or more successive, unidirectional segmented positions during the course of the entire hour. Preferably, the digital time display can switch from a unidirectional display to a quadribalanced or enhanced quadribalanced remaining time display whenever such a transition is desired. It is also preferred that there are only four segmented positions for the elapsed minutes display. The switch from unidirectional to quadribalanced or enhanced quadribalanced display can occur in any one of the segmented positions.

In broad terms, the invention is based on the concept that fully unidirectional elapsed time displays should be segmented into four quarter hour periods, with such periods moving from relatively upper to lower positions on the right side of the current hour during the first half hour, and thereafter from relatively lower to upper positions on the left side of the same current hour during the second half hour.

In such displays, the minutes are unidirectionally incremented from zero to 59 during the entire hour, with quarter hour position shifts around the perimeter of a centrally positioned current hour display, thus imparting the graphics of rotary motion to the minute digits in a manner not heretofore described.

Alternatively, such elapsed time displays can be made to switch during the second half hour to the then equivalent quadribalanced or enhanced quadribalanced display at the option of the viewer, so that he or she may decide when such a transition should be activated.

Other features and details of the invention will be understood from the subsequent specific description, read in connection with the drawings.

DESCRIPTION OF THE PREFERRED EMBODIMENT

Figure 1:
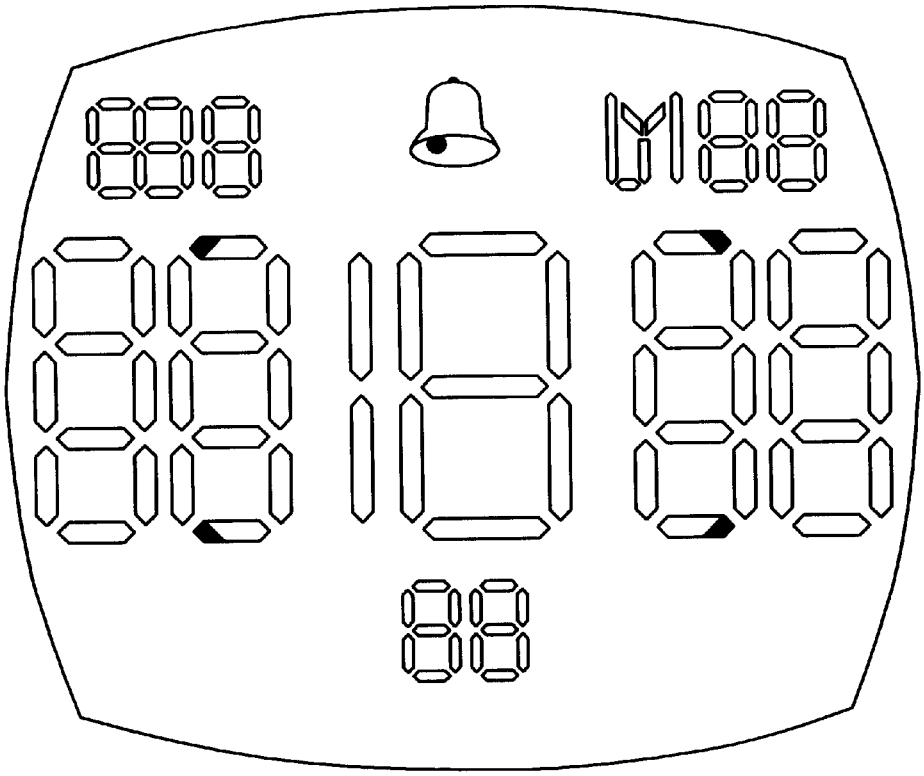
FIG. 1 is a master drawing of a layout of digital display elements that can be activated to display unidirectional segmented time displays in accordance with a preferred embodiment of the present invention.
Figure 7:
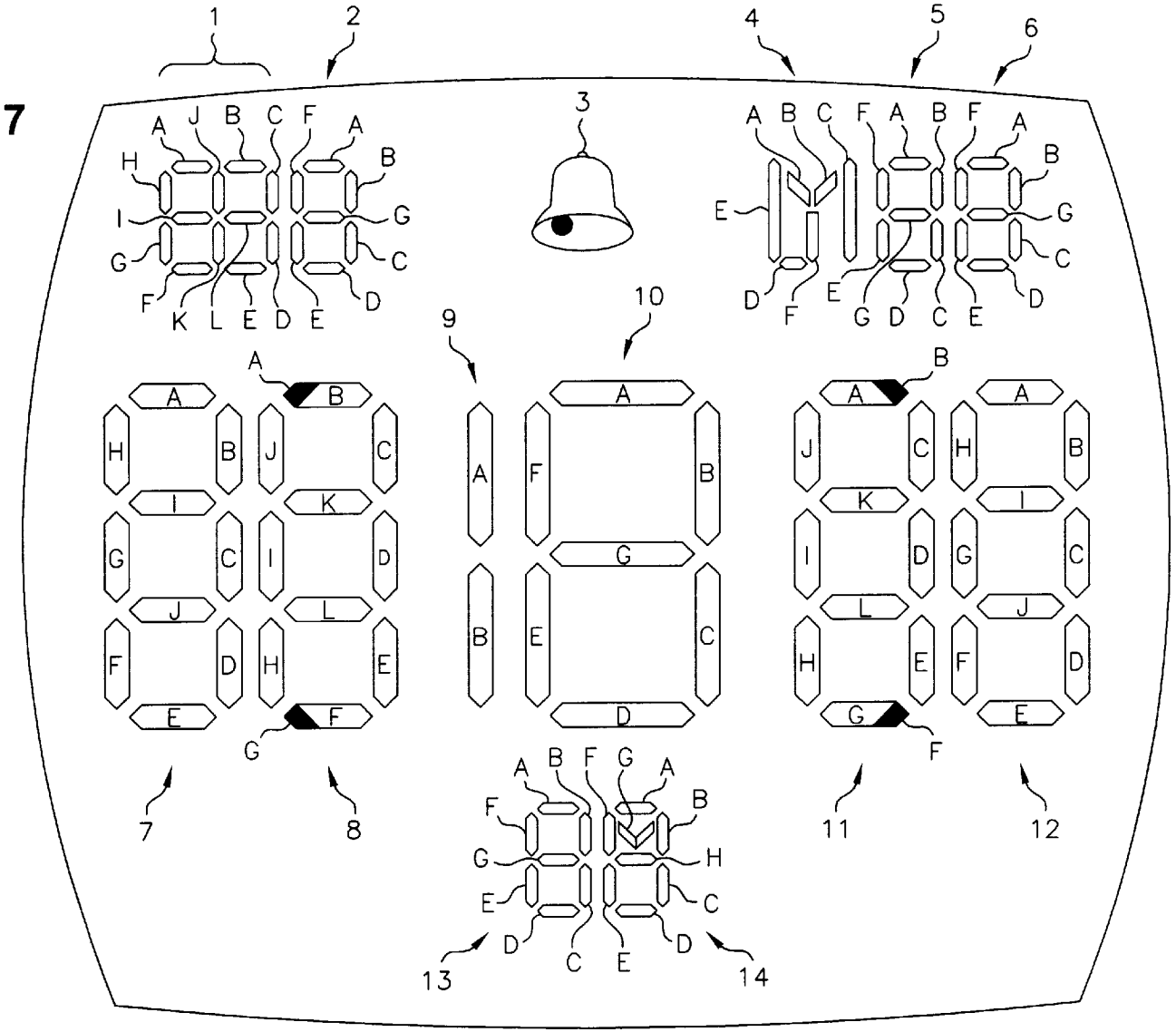
FIG. 7 is an enlarged view of FIG. 1 with added alphanumeric labels for each digital display element.

Referring to FIGS. 1 and 7, FIG. 1 illustrates multiple sets of digital display elements which are numbered 1 through 14 in FIG. 7. The layout of these sets is similar to FIG. 1 of U.S. Pat. No. 6,215,736 B1.

Sets 1 and 2 are activatable to display two-letter abbreviations of the names of the seven days of the week. Set 3 is an alarm icon which becomes activated when an alarm setting sounding mode is initiated. Set 4 is activatable to display prefix letters "M", "D" and "Y" to facilitate setting the dates of a current month, day or year, formed and displayed by Sets 5 and 6, as described in Published Application U.S. 2002/0089897 A1, published Jul. 11, 2002.

Sets 9 and 10 are activatable to display hour digits 1 through 12. In accordance with the present invention, Sets 7, 8, 11 and 12 are activatable to display four respective groups of elapsed minute digits during successive quarter hour periods past a current hour, as will be discussed below in reference to FIGS. 3–6.

Figure 2:
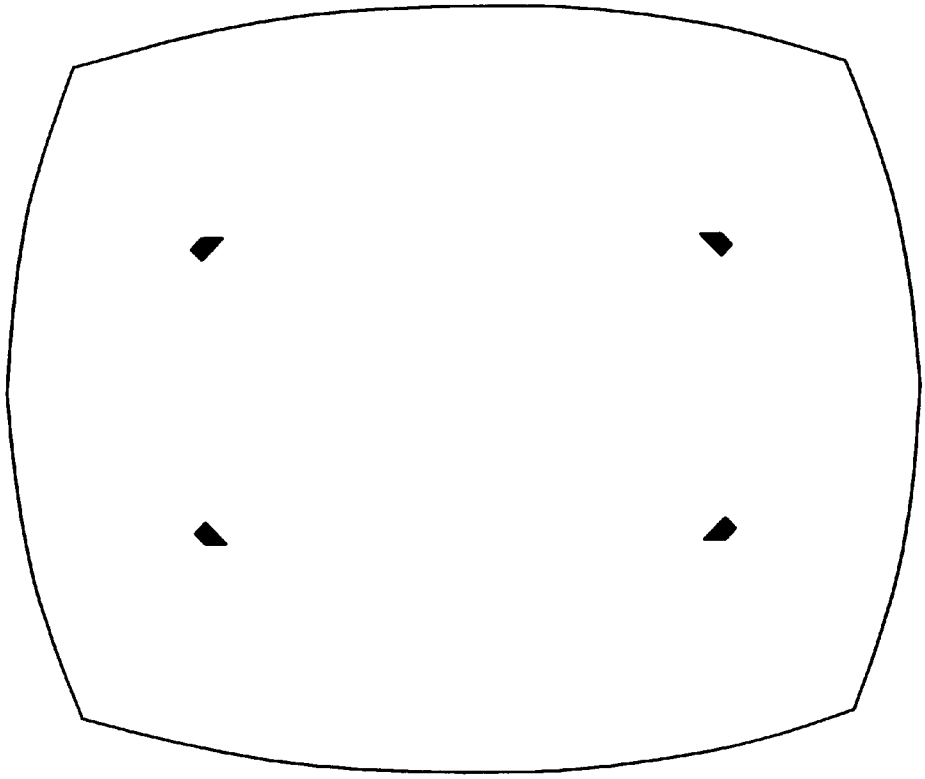
FIG. 2 is a drawing of quarter hour position markers formed by activating the blackened sections of four of the digital display elements shown in FIG. 1.

The blackened sections of four of the display elements in sets 8 and 1, namely 8A, 8G, 11B and 11F, are separately activatable to display quarter hour markers, as illustrated in FIG. 2.

Sets 13 and 14 are activatable to display zero to 59 seconds during each elapsed minute. Due to the inclusion of the V-shaped element G in set 14, these sets are also activatable to facilitate AM/PM hour settings, as described in U.S. Pat. No. 6,418,085 B2, the disclosure of which is incorporated herein by reference.

Figure 3:
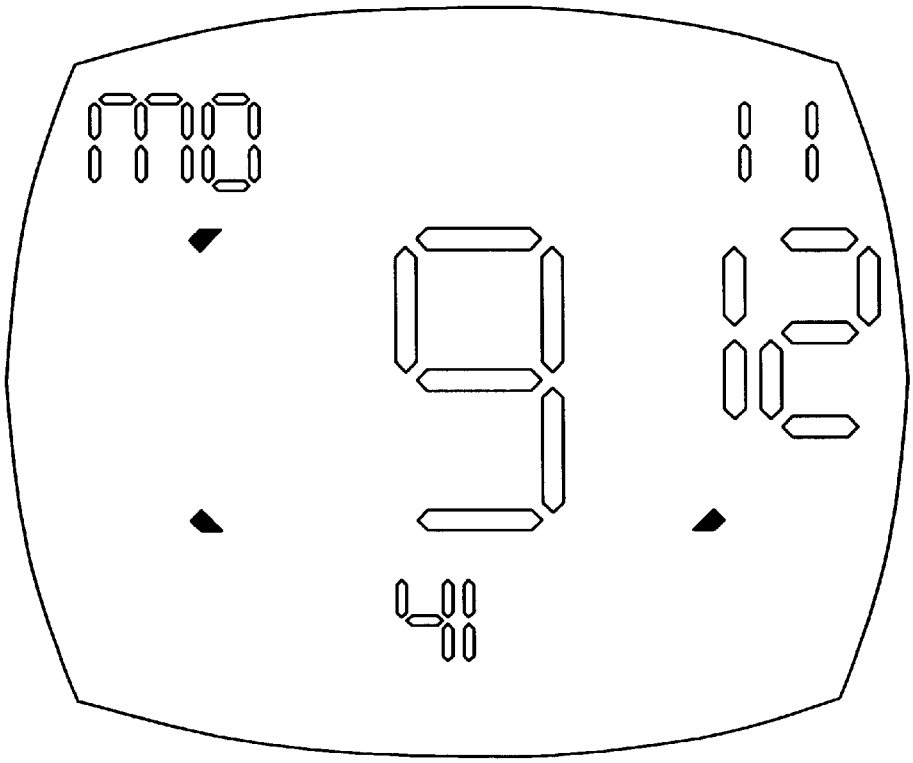
FIGS. 3–6 display representative time displays during the successive four quarters of an hour in accordance with the preferred embodiment of the invention.
Figure 4:
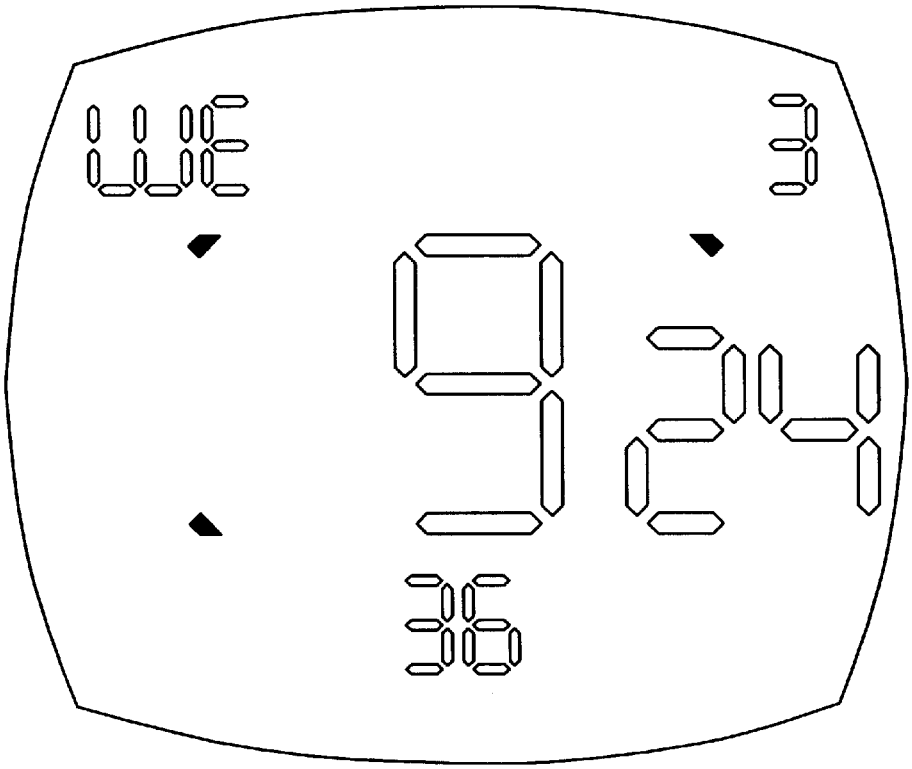

Referring now to FIGS. 3–6, illustrated there are representative time (and day date) displays of the unidirectional, segmented timekeeping system provided by the present invention. In FIG. 3, the current hour digit is 9, elapsed minutes are 12, and elapsed seconds are 41. Quarter hour markers 11F, 8A and 8G are also activated to signify that these areas will be filled with time information as the current hour progresses.

The display format of FIG. 3 is preferably maintained during the first fifteen minutes of hour 9, until the minute/seconds values reach 15 minutes and 59 seconds (11CD, 12AHICJ and 13AFGCD, 14AFHGCD, respectively). Thus, during that period the minute values are controlled to occupy a relatively upper position on the right side of hour digit 9.

Thereafter, at the next second the display preferably is activated to undergo a transition that shifts the next time values of 16 minutes and zero seconds to a relatively lower position on the same side of hour digit 9., i.e., such is accomplished by activating the elements 11DE, 12IGJDEF and 14ABCDEF. Simultaneously, marker 11B is activated to signify that the first quarter position no longer provides time information and that the next quarter hour period of time will be displayed in the relatively lower second quarter position, illustratively depicted in FIG. 4 to display the representative time of 24 minutes and 36 seconds past hour 9.

Figure 5:
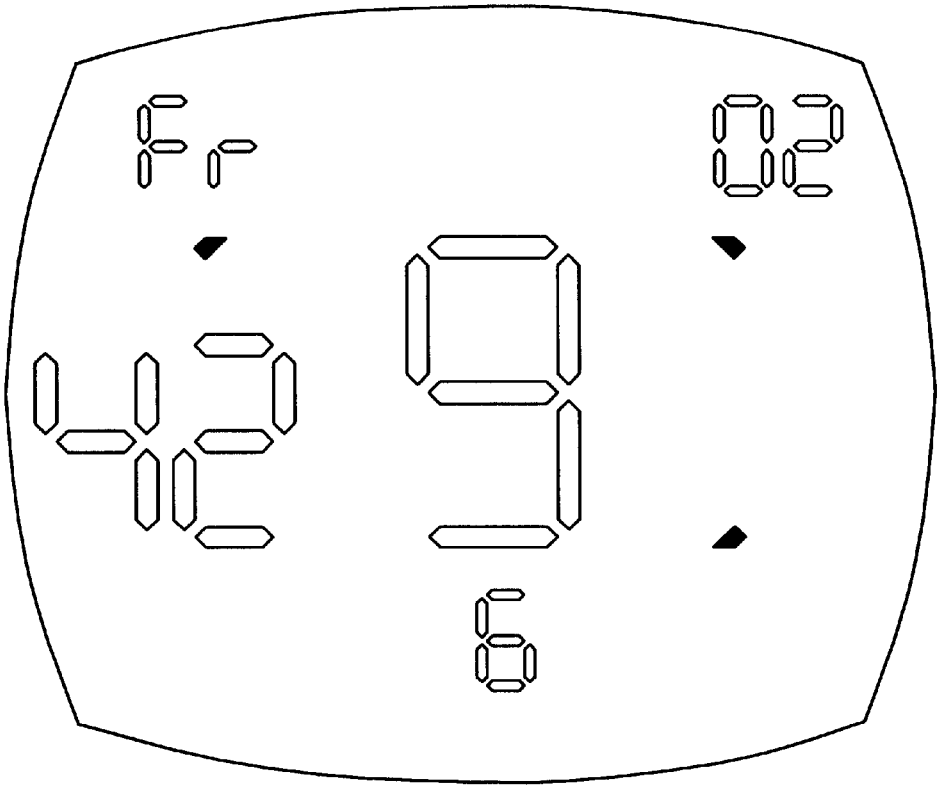
Figure 6:
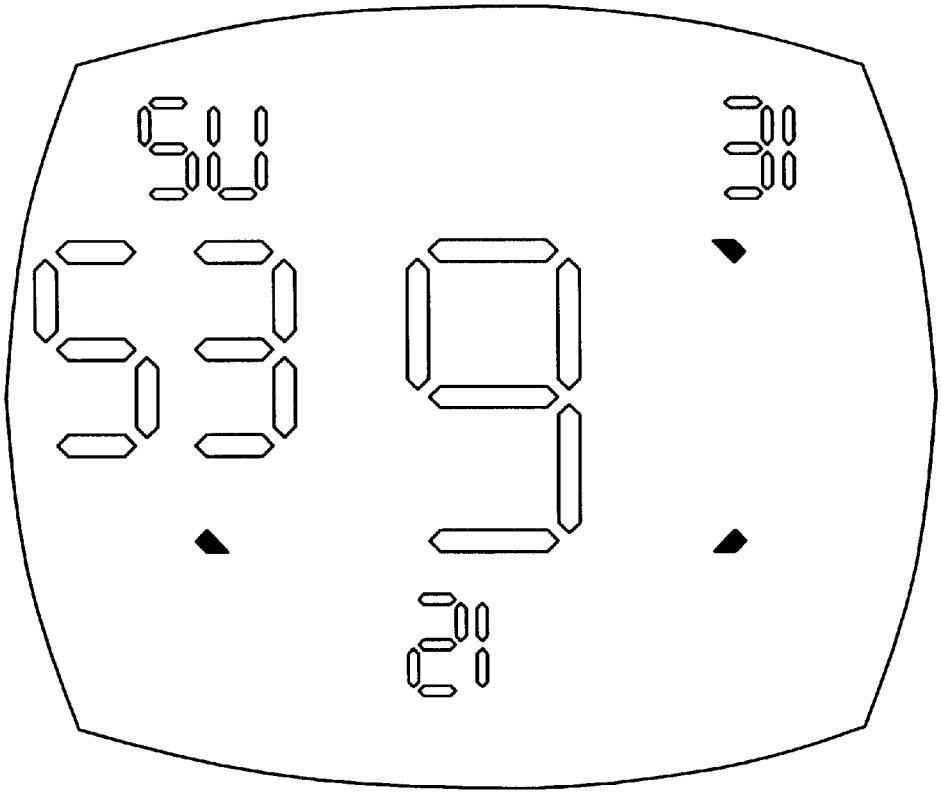

This second quarter display is maintained until completion of the next fifteen minutes, from 16 to 30, which is indicative, as well, of completion of the first half of hour 9. After another 59 seconds, the display is preferably activated to undergo another transition which shifts the display of minutes to the left side of hour 9, i.e., the next displayed time values will be 31 minutes and zero seconds (by activation of 71CJDE, 81H and 14ABCDEF). Simultaneously, quarter hour marker 11F is activated to join with marker 11B in signifying that the first two quarter hour positions are no longer providing time information. Thus, FIG. 5 is illustrative of the representative time of 42 minutes and 6 seconds past hour 9 in the third quarter hour period.

This third quarter display position is preferably maintained during the fifteen minute period from 31 to 44 elapsed minutes after hour 9. After the next 59 seconds, the display is controlled to undergo a fourth and final transition whereby the minute digits are shifted to the relatively upper position on the left side of hour 9, by activation of 7HIBC, 8ABJKDL and 14ABCDEF to display 45 minutes and zero seconds past hour 9. Simultaneously, third quarter hour marker 8G is activated to join with markers 11B, 11F in signifying that the first three quarter positions are empty of time information and that the last fifteen minutes past hour 9 will be displayed in the relatively upper position on the left side of that hour. That position is illustratively activated in FIG. 6 to display the representative time of 53 elapsed minutes and 21 seconds.

This final quarter hour display will be maintained until completion of 59 minutes and 59 seconds, after which the hour will increment to 10 (by activation of 9AB, 10ABCDEF) and minutes and seconds will shift to display zero values (by activation of 11ABCDLIJ, 12ABCJGH and 14ABCDEF) in the relatively upper position on the right side of hour 10. The three quarter hour markers 11F, 8A, 8G will be simultaneously activated to complete the appearance of the display at the commencement of the now current hour 10.

The foregoing description of a preferred embodiment of the invention demonstrates its capabilities and advantages. First, it graphically portrays the progress of each current hour in quarter hour unidirectional segments and positions of elapsed minutes which traverse generally around the centrally positioned hour digits. This enables determining, at a glance from just the appearance of the display, the prevailing quarter hour position in which the specific time currently exists. Therefore, unlike conventional digital time displays, the timing of individual daily activities can be approximated in context of each hour's broad progressions in elapsed time, from beginning to end, due to the visually distinguishable geometries that are provided during the respective quarterly time periods.

These capabilities are achieved without loss of the precision and instantly comprehensible digital time values that are provided by the hour, minute and seconds digits.

In addition, the setting or resetting of the digital time values of hours, minutes and seconds is facilitated since each of these time quantities occupies a unique and instantly recognizable size and position in the displays, thus avoiding uncertainty or confusion over which time function has been selected and is available for a change in value.

Another important and valuable advantage is that the displays of the invention can be readily modified to track time during an hour on the bases of both elapsed time past a current hour and remaining time before a forthcoming next hour. In particular, as previously noted, the prior art has described quadribalanced and enhanced quadribalanced digital time displays. The displays of the current invention can be programmed in integrated circuits to operate both on an elapsed time basis and a simultaneously equivalent remaining time basis, preferably after the first half hour, with an included switch that is operable to alternate between these two bases, at a time that a viewer may wish to choose during the second half hour.

This will enable individuals to delay a transition from elapsed to remaining modes at exactly the completion of a first half hour, and thus wait until more of the second half hour has elapsed before initiating the remaining time mode to specifically track the gradually closer approach of the next hour.

In this connection, preferably such modified displays will include a single crown control of the type described in U.S. Pat. No. 6,286,991 B1, the disclosure of which is incorporated herein by reference, together with a fifth control element dedicated solely to perform the above-noted switching function in the modified displays of this invention. Such additional control element may be, for example, a push-in capability added to the above-cited single crown control, or a separate push button, or a touch sensitive area of a timepiece face which, in each case, is operative to make contact with an internal terminal that will initiate the switching function between the unidirectional and bidirectional displays described above.

The alphanumeric-labeled display elements of FIG. 7 are highly useful for specifying the activation sequences of the time, day and date functions involved in practicing the present invention. A qualified embedded systems software programmer has estimated, after review of such specifications, that the program can be written in approximately 35 days. Also, vendors of suitable microprocessors for application in timepieces utilizing the invention include Texas Instruments MSP430 series, Microchip PIC16 series, Hitachi H8 series and OKI MSM64K series.

The present invention may be practiced with various forms of digital display elements, e.g., LCD, LED, fluorescent, incandescent, gaseous glow or plasma discharges, or dot matrix elements that can be selectively activated, electronically or electrically, to display the time values and sequences described above.

In conclusion, the present invention has been described in terms of its general principles and specific embodiments. Many variations of such disclosure will be obvious to those skilled in the art. Accordingly, it should be understood that the ensuing claims are intended to cover all changes and modifications of the specific illustrative embodiments which fall within the literal scope of the claims and all equivalents thereof.

What is claimed is:

1. Unidirectional segmented digital time displays which comprise:

(a) multiple digital display elements which are activatable to display current or next hour digits, (b) multiple digital display elements located on the right side of elements (a) which are activatable to display selected elapsed minute digits past a current hour in relatively upper and lower positions, (c) multiple digital display elements located on the left side of elements (a) which are activatable to display selected elapsed minute digits past the current hour in relatively lower and upper positions, elements (b) being activated to display selected first and second respective groups of elapsed minute digits in the relatively upper and lower positions, during approximately the first half of a current hour, and elements (c) being activated to display selected respective third and fourth groups of elapsed minute digits in the relatively lower and upper positions, during the remaining portion of the current hour, whereby the elapsed minute digits are graphically displayed to traverse around the current hour digit in four successive, unidirectional segmented positions during the course of the entire hour.

2. Displays according to claim 1 wherein the selected first through fourth groups of the elapsed minute digits comprise the first through fourth quarters, respectively, of the current hour.

3. Displays according to claim 2 wherein the first through fourth quarters of the current hour each comprises a period of fifteen elapsed minutes.

4. Displays according to claim 3 wherein the first through fourth quarters of the current hour comprise the successive groups of zero to 15 minutes, 16 to 30 minutes, 31 to 44 minutes and 45 to zero minutes, said groups of elapsed minute digits being displayed in the successive relatively upper and lower positions on the right side of the hour followed by the relatively lower and upper positions on the left side of the hour.

5. Displays according to claim 4 which further comprise (d) multiple digital display elements which are activatable to display zero to 59 seconds during each elapsed minute.

6. Displays according to claim 5, wherein the elements (d) are located below the current hour digit and are activated to display zero to 59 seconds in that position during each elapsed minute.

7. Displays according to claim 1 wherein said elements (a) include elements activatable to form a tens of hours digit and a FIG. 8 set of elements activatable to form unit values of hour digits from zero to nine, elements (b) include a pair of ten-segmented ladder arrays the uppermost seven segments of which being activatable to display a first group of selected elapsed minute digits in the relatively upper position during the first quarter of a current hour and the lowermost seven segments of which being activatable to display a second group of selected elapsed minutes in the relatively lower position during the second quarter of the current hour, and elements (c) include a pair of ten-segmented ladder arrays the lowermost seven of which being activatable to display a third group of selected elapsed minutes in the relatively lower position during the third quarter of the current hour and the uppermost seven of which being activatable to display a fourth group of selected elapsed minutes in the relatively upper position during the fourth and final quarter of the current hour.

8. Combination unidirectional segmented and bidirectional quadribalanced or enhanced quadribalanced digital time displays which comprise:

(a) multiple digital display elements which are activatable to display current or next hour digits, (b) multiple digital display elements located on the right side of elements (a) which are activatable to display selected elapsed minute digits past the current hour in relatively upper and lower positions, (c) multiple digital display elements located on the left side of elements (a) which are activatable to display either selected elapsed minute digits past the current hour or selected remaining minute digits before the next hour, elements (b) being activated to display selected first and second respective groups of elapsed minute digits past the current hour in the relatively upper and lower positions, during approximately the first half of a current hour, and elements (c) being activated to display either (i) selected third and fourth respective groups of elapsed minute digits in the relatively lower and upper positions, during the remaining portion of the current hour or (ii) selected first and second respective groups of remaining minute digits before the next hour, displayed by elements (a), in the relatively lower and upper positions, during the remaining portion of the period before the next hour, whereby the combination may be activated to display only the unidirectional elapsed minutes sequence of (b)(c)(i) or the bidirectional elapsed and remaining minutes sequence of (b)(c)(ii), as a viewer may choose.

9. Displays according to claim 8 which further comprise (d) multiple digital display elements which are activatable to display zero to 59 seconds during each elapsed minute and 59 to zero seconds during each remaining minute.

10. Displays according to claim 9 wherein the elements (d) are located below elements (a) to display such incrementing or decrementing seconds below the hour digits.

11. Displays according to claim 8 which include a switch operable to alternate between the unidirectional elapsed minutes sequence of (b)(c)(i) and the bidirectional elapsed and remaining sequence of (b)(c)(ii) at times chosen by a viewer thereof.

12. A method of performing unidirectional segmented digital timekeeping which comprises:

(a) providing multiple digital display elements which are activatable to display current or next hour digits, (b) providing on the right side of elements (a) multiple digital display elements, which are activatable to display selected elapsed minute digits in relatively upper and lower positions, (c) providing on the left side of elements (a) multiple digital display elements which are activatable to display selected elapsed minute digits in relatively lower and upper positions, (d) activating elements (a) to display a current hour digit, (e) activating elements (b) to display selected first and second respective groups of elapsed minute digits past the current hour in the relatively upper and lower positions, and (f) activating elements (c) to display selected third and fourth respective groups of elapsed minute digits past the current hour in the relatively lower and upper positions, whereby the elapsed minute digits are graphically traversed around the current hour digit in successive unidirectional segmented positions during the course of the entire hour.

13. A digital timekeeping method according to claim 12 which further comprises selecting the first through fourth groups of elapsed minute digits to correspond to the four quarters of the current hour.

14. A digital timekeeping method according to claim 13 which further comprises selecting fifteen minute periods as the lengths of the four quarters of the current hour.

15. A digital timekeeping method according to claim 14 which further comprises activating the elements (b) and (c) to display successive elapsed minute digits of zero to 15 minutes, 16 to 30 minutes, 31 to 44 minutes and 45 to zero minutes during the four quarters of the current hour.

16. A digital timekeeping method according to claim 15 which further comprises providing below the current hour digits (g) multiple digital display elements which are activatable to display zero to 59 seconds and activating the same to display such seconds during each elapsed minute.

17. A method of performing combined unidirectional segmented and bidirectional quadribalanced or enhanced quadribalanced digital timekeeping which comprises:

(a) providing multiple digital display elements which are activatable to display current or next hour digits, (b) providing on the right side of elements (a) multiple digital display elements which are activatable to display selected elapsed minute digits in relatively upper and lower positions, (c) providing on the left side of elements (a) multiple digital display elements which are activatable to display either selected elapsed minute digits past the current hour or selected remaining minute digits before the next hour, (d) activating elements (a) to display a current hour and simultaneously activating elements (b) to display selected first and second respective groups of elapsed minute digits past such current hour in the upper and lower positions, respectively, during approximately the first half of such hour, (e) activating elements (c) to display either (i) selected third and fourth respective groups of elapsed minute digits in the relatively lower and upper positions, during the remaining period of the current hour or (ii) activating elements (a) to display the next hour and simultaneously activating elements (c) to display selected first and second respective groups of remaining minute digits before the next hour in the relatively lower and upper positions, during the remaining period of the current hour, whereby the timekeeping procedure may be controlled to display either the unidirectional elapsed minutes sequence of (e)(c)(i) or the bidirectional elapsed and remaining minutes sequence of (e)(c)(ii), as a viewer may choose.

18. A digital timekeeping method according to claim 17 which further comprises providing below the current or next hour digits (f) multiple digital display elements which are activatable to display zero to 59 seconds during each elapsed minute and 59 to zero seconds during each remaining minute, and initiating activation of such incrementing and decrementing seconds during each elapsed and each remaining minute.

19. A digital time keeping method according to claim 18 which further comprises providing a switching means for clip alternating the display between the unidirectional sequence of (e)(c)(I) and the bidirectional sequence of (e)(c)(ii), as a viewer may choose.

* * * * *

UNITED STATES PATENT AND TRADEMARK OFFICE

CERTIFICATE OF CORRECTION

PATENT NO. : 6,584,041 B1
DATED : June 24, 2003
INVENTOR(S) : Berj A. Terzian et al.

It is certified that error appears in the above-identified patent and that said Letters Patent is hereby corrected as shown below:

Column 3,
Line 6, change "1" to -- 11 --;

Column 6,
Line 7, change "FIG." to -- figure --;

Column 8,
Line 46, delete "clip".

Signed and Sealed this

Fourteenth Day of October, 2003

JAMES E. ROGAN
*Director of the United States Patent and Trademark Office*